United States Patent [19]

Zöllner geb. Möller

[11] 4,379,723

[45] Apr. 12, 1983

[54] METHOD OF REMOVING ELECTROCATALYTICALLY ACTIVE PROTECTIVE COATINGS FROM ELECTRODES WITH METAL CORES, AND THE USE OF THE METHOD

[75] Inventor: Christine Zöllner geb. Möller, Schwaig/b. Nuremberg, Fed. Rep. of Germany

[73] Assignee: C. Conradty Nurnberg GmbH & Co. KG, Fed. Rep. of Germany

[21] Appl. No.: 291,407

[22] Filed: Aug. 10, 1981 (Under 37 CFR 1.47)

[30] Foreign Application Priority Data

Aug. 28, 1980 [DE] Fed. Rep. of Germany ..... 3032480

[51] Int. Cl.[3] ..... H01H 9/30; C23G 1/00

[52] U.S. Cl. ..... 134/2; 148/6.3; 204/146

[58] Field of Search ..... 134/2, 19; 148/6.3; 204/141.5

[56] References Cited

U.S. PATENT DOCUMENTS

| | | | |
|---|---|---|---|
| 3,502,503 | 3/1970 | Bartlo et al. | 134/2 |
| 3,573,100 | 3/1971 | Beer | 134/2 |
| 3,684,577 | 8/1972 | Hitzel | 134/2 |
| 3,706,600 | 12/1972 | Pumphrey et al. | 134/2 |
| 3,730,856 | 5/1973 | Hines et al. | 204/141.5 |
| 3,732,123 | 5/1973 | Stolfa et al. | 134/19 |
| 3,761,312 | 9/1973 | Entwisle et al. | 134/2 |
| 4,233,086 | 11/1980 | Vesterlund | 148/6.3 |

*Primary Examiner*—Sam Silverberg

*Attorney, Agent, or Firm*—Brooks, Haidt, Haffner & Delahunty

[57] ABSTRACT

A method of removing electrocatalytically active protective coatings from electrodes with metal cores, in which a non-adhesive intermediate layer of a compound of the substrate metal is produced in a position between the protective coating and the substrate structure by means of controlled thermal treatment. By using the method, deactivated protective coatings can be removed in a particularly easy manner from electrodes with valve metal cores.

14 Claims, No Drawings

METHOD OF REMOVING ELECTROCATALYTICALLY ACTIVE PROTECTIVE COATINGS FROM ELECTRODES WITH METAL CORES, AND THE USE OF THE METHOD

FIELD OF INVENTION

The invention relates to a method of removing electroconductive coatings from electrodes with metal cores for electrochemical processes, and the use of the method.

DESCRIPTION OF PRIOR ART

Electrodes of this type have been used increasingly for a number of years in particular for the electrolysis of aqueous solutions of alkali halides, as they operate more economically in the majority of cell types than the conventional graphite anodes. Although the life time of the coatings continuously increases due to improved coating methods and the trend towards lower current densities, the activity of the anode surface decreases over the period of continuous use due to progressive anodic passivation, formation of foreign deposits, partial destruction of the structure due to short-circuiting or due to mechanical removal of the surface coating, to such an extent that recoating becomes necessary.

When the metal electrodes are taken out of service they still retain on their surface an appreciable proportion of the original coating. This contains noble metal compounds or other inert materials which are difficult to remove by conventional chemical or electrochemical means. Attempts to deposit the new coating for metal electrodes directly on to the remains of the old coating (DE-OS No. 21 57 511) have not proved satisfactory in practice, as various subsequently published patent specification such as U.S. Pat. No. 3,684,577 and U.S. Pat. No. Re 28,849 demonstrate.

The need is therefore generally recognised by those skilled in the art that all traces of the degraded coating must be removed from the metal substrate, but with a minimum of damage to the metallic support assembly. The newly formed surface of the substrate should also demonstrate good adhesion properties in applying the new coating. A very important requirement for an economical recoating process is that the valuable coating metals should be able to be recovered from the deactivated coating.

Mechanical removal of the coatings by means of dry or wet sandblasting has already been described in DE-OS No. 28 15 955, 26 38 218 and 26 45 414. Although this represents the most widely used method, it has the drawback of very high labour costs in manual sandblasting, and of being unable to prevent high losses of structural material in automatic sandblasting. In addition, because of the abrasive properties of the blasting medium, it is very difficult to recover the precious metals or compounds from the used blasting medium, which according to tests contains not more than 3% of coating material.

Other methods for removing degraded coatings from metal anodes are however also known. For example, GB Pat. No. 1,360,915 describes a method wherein the electrodes are immersed at a temperature of between 300° and 550° C. in a fused salt bath formed substantially from at least one hydrogen sulphate or pyrosulphate of an alkaline metal or of ammonium, the electrode treated in this manner being subjected to rinsing with water after cooling. U.S. Pat. No. 3,684,577 describes a method for removing the electrically conducting coating from a titanium structure wherein the support structure is brought into contact with a fused salt bath consisting of a mixture of 1 to 15 parts by weight of an alkaline metal hydroxide and 1 part by weight of an alkali salt of an oxidising agent.

Practically identical with this is DE-PS No. 19 09 757, wherein the anodes are treated at a temperature of 250° C. with a salt bath of potassium or sodium nitrate which also contains a strong inorganic base.

A somewhat different method is described in U.S. Pat. No. 3,761,312. In this, the electrodes are subjected to a two-stage pickling process in which the first pickling bath contains 0.3 to 3% of $H_2O_2$ together with any required acids and bases, and the second pickling liquid consists of 20 to 30% hydrochloric acid.

Finally, U.S. Pat. No. 28,849 describes an electrolytic cleaning method in which the electrode to be cleaned is connected as the anode in an electrolyte which contains 5 to 70% of a sulphate, nitrate, perchlorate, chlorate, a persulphate or a mixture thereof. It is then electrolysed at a current density of 1 to 100 $A/dm^2$.

These methods are more suitable as laboratory methods than for technical use. In particular, methods which operate with acid salts or acids are not suitable for treating titanium anodes of industrial design after industrial use, as such structures comprise parts which either were never provided with a protective coating or have completely lost the protective coating by shortcircuiting. On treatment with acid chemicals, these parts thus immediately become very heavily attacked, whereas the surface layer to be removed is only slightly dissolved or not at all.

In methods of the type such as that described in U.S. Pat. No. 3,684,577, there are considerable dangers because of the fact that some of the oxidising fused salt baths used therein react explosively with titanium even on slight heating (GMELIN, Handbuch der anorganischen Chemie, System No. 41, 198 (1951). This is also the case for the fused salt baths of DE-PS No. 19 09 757, but only at elevated temperature.

STATEMENT OF OBJECTIVES

The object of the invention is to provide a simple and economical method of removing used coatings from metal electrodes in order to expose a clean surface for recoating, in which the attack of the metal core is minimal and in particular uniform, and the valuable components of the protective coatings can be completely and simply recovered. The method is also required to be usuable particularly on valve metal electrodes with protective coatings containing precious metal.

SUMMARY OF INVENTION

This object is attained by a method of the initially described type, characterised in that a non-adhesive intermediate layer of a compound of the substrate metal is produced in a position between the protective coating and the substrate by means of controlled thermal treatment.

The metal substrate can be of any metal or any metal alloy, on which a non-adhesive compound can be produced.

Various physical phenomena contribute to this non-adhesion of the newly formed compound layers, such as the Pilling-Bedworth principle according to which for example oxides assume a greater volume than the metals from which they are formed, or because of the different thermal expansion coefficients, or because of the formation of gaseous compounds such as oxides, hydrides etc., or because of the bond weakening in the boundary layer due to diffusion of cations out of the metal (Kirkendall effect), and the like.

The nature of the coating fixed to the metal support is not critical. The electrocatalytically active protective layers used for chlorine-alkali electrolysis and related electrochemical processes generally consists of oxygen containing compounds of platinum metals and have a layer thickness of a few microns. However, the chemical composition of the coating and its thickness can vary within wide limits without impeding, in particular at elevated temperatures, the solid state diffusion of cations and/or anions through the remaining coating, in particular in the case of used coatings, this being necessary for the formation of the non-adhesive compound layer.

In the method according to the invention, the formation of oxides, carbides, nitrides, hydrides or combinations thereof is particularly advantageous.

Generally, the formation of the non-adhesive intermediate layer between the coating and metal substrate is attained by carrying out the thermal treatment at a temperature of 400° 1 to 900° C. In particular, the thermal treatment is carried out in a gas atmosphere comprising at least a proportion of an oxygen-, carbon-, nitrogen- or hydrogen-yielding component or a mixture thereof, according to the required compound. In order to optimise the conditions, some controlled tests are desirably required for each new combination of metal substrate and protective coating, possibly with the aid of thermogravimetric and differential thermoanalytic methods, as the available literature relates primarily to the compound formation on unprotected metals. Caused by the impeded ion diffusion through the protective layer, formation of for example slightly under-stoichiometric compounds, e.g. oxides, takes easily place at the metal-oxide-interface, which compounds are formed on unprotected surfaces only under substantially different conditions such as under very strongly reduced gas pressure.

According to the method of the invention, as already stated it is preferable for the thermal treatment to be carried out in a gas atmosphere with at least a proportion of an oxygen-, carbon-, nitrogen- or hydrogen-yielding component, or a mixture thereof, according to the desired non-adhesive compound. Air or mixtures containing a lower proportion of oxygen can for example be used as the oxygen-yielding component. As the diffusion of the gas through the cover layer to be removed frequently represents the rate determining step, an increase in the partial pressure of oxygen in the gas generally brings no special advantage. The carbon-yielding component can for example be an atmosphere containing hydrocarbons. The nitrogen- or hydrogen-yielding component can be primarily nitrogen, its hydrogen compounds or hydrogen. It can be sometimes desirable to add to the reaction atmosphere a gas which is inert under the treatment conditions. The rare gases, preferably argon etc., can for example be used as such an inert gas.

However, it is also possible to carry out the thermal treatment for the production of a non-adhesive oxide by anodic oxidation in a non-oxidising fused salt bath, e.g. at a temperature above 650° C.

It is apparent that the temperature and time conditions can vary to a certain extent according to the thickness of the coating to be removed, the type of reaction gas used and its partial pressure.

Surprisingly it was now found that the detailed geometry of the electrode structure can play a substantial role in fixing the reaction conditions. For example, a non-adhesive oxide can be formed on a coated flat-planar titanium body by subjecting it to temperature treatment at 650° to 700° C. in air. In this manner, a white titanium oxide forms at the metal oxide interface which on cooling the body causes the whole coating to exfoliate. However, if coated round material such as wire or expanded metal of 3 to 5 mm diameter is treated under the same reaction conditions, the same titanium oxide formed as the intermediate layer firmly adheres to the substrate and cannot be removed by brushing with a wire brush or similar methods. Even longer reaction times, thermo-shock treatment or raising of the reaction temperature to around 750° C. do not result in complete loosening of the coating from the substrate. This phenomenon can be explained if it is assumed that the cylindrical oxide growth in the said temperature range follows the Pilling-Bedworth principle, i.e. on account of its increased volume, with radial growth on the cylindrical material but without stress in the hoop direction, due to the fact that the area available for growth, $2\pi(r+\Delta r).h$, increases in linear proportion to the layer thickness of the growing oxide, $r+\Delta r$.

The removal of used coatings from wires having a diameter of less than 1 cm or from expanded metal with a bar width and bar height of less than 0.5 cm is however of special importance, because the activated metal anodes used in industrial electrolysis are predominantly of the following two structural types:

(a) In anodes for horizontal cells, the actual anode surface is formed by a grid from parallel titanium wires having a diameter of about 3 to 5 mm, and welded a few mm apart on a current distribution system consisting of several solid titanium bars (butterfly). The current is supplied by means of a copper rod which is screwed into the butterfly, and is protected against chlorine attack by means of a titanium tube welded thereon.

(b) In alkaline chloride electrolysis according to the diaphragm or membrane method, box anodes are used having outer dimensions of about 0.5 to 2 m edge length and a depth of a few cm. The basket walls consist of rolled or non-rolled expanded metal coated with precious metal and having a bar height and width of mostly 0.5 to 3 mm. For current supply purposes, a titanium plated copper rod is welded to the basket walls ("Chlorine-alkali Electrolysis" of "Chemie-Ingenieur-Technik, " 47, 126 (1975) FIGS. 1 and 4).

It has now surprisingly been found that metal anodes of the design heretofore described, of which the activated surface consists substantially of wires, rods or expanded metal, with a diameter less than 1 cm respectively, can be decoated by means of the method of the invention.

For this purpose a very controlled thermal treatment is necessary, in which the titanium electrodes with used coating of said design are heated up very rapidly to the temperature range of 800° to 870° C. for about 5 to 15 minutes, and preferably 7 to 8 minutes. A very fine black, X-ray amorphous, under-stoichiometric titanium oxide is then formed as an intermediate layer. On cooling, the coating is easily peeled off. In the case of complicated structures, all the residual coating can easily be removed by brushing or compressed air (without sand).

The conditions for the heat treatment are less critical for electrodes which consist of a solid sheet valve metal substrate and electrocatalytically active coating. Electrodes of this type can be heat treated at a temperature of 600° to 700° C. for a period of more than 20 minutes. The heat treatment can also comprise several cycles. The coating exfoliates during cooling if the intermediate, non-adhering layer has reached a certain thickness.

In general, it can be important to adhere to the following parameters in forming the non-adhesive intermediate oxide layers according to the invention.

The samples should be predried, as traces of water favour the formation of firmly adhereing films of compound, and in particular oxide films. The predrying treatment preferrably shall be carried particularly in the range of 130° to 250° C.

The satisfactory temperature ranges determined by orientative tests should be very strictly adhered to, so that a determined compound such as an oxide forms. In particular, the low temperature ranges should be passed through very quickly, both during heating-up and cooling down, if an adhesive compound can be formed in the lower temperature range. Furthermore, a determined treatment time must not be exceeded, in order not to allow a non-adhesive under-stoichiometric compound to be converted into a comound of a higher degree of oxidation which adheres to the metal surface. This is particularly so in the case of oxide formation. Generally, short reaction times should be strived for, so that the intermediate layer does not become unnecessarily thick.

The method according to the invention has the considerable advantage that the removal of the deactivated coating is very uniform, complete and easy to control, even in the case of complicated structures. The newly obtained surface of the support structure can be directly recoated without further processing steps such as etching, degreasing, rinsing, etc. The new coatings then adhere as firmly as the previous coating, and they have the same favourable electrochemical properties. The method is very little labour and time intensive. Moreover, the deactivated old coating is obtained in pure form, so that the recovery of the valuable precious metals which are still contained is easily possible without complicated separation from strongly abrasive sandblasting material or corrosive fused salt baths and etching baths.

The invention is illustrated hereinafter with reference to some embodiments:

EXAMPLE 1

A titanium plate of 860×420×3 mm was provided with a precious metal-containing coating especially suitable for chlorate electrolysis and having a layer thickness of 15 μm. The plate was used for three years in industrial chlorate electrolysis. By gammascopic tests the residual coating was found to still have an average layer thickness of 10 μm. The plate was predried for 20 minutes at 175° C., was then held at 650° C. for 40 minutes in a preheated furnace, was then immediately taken out and cooled in the surrounding air. The coating could be lifted off in large pieces. On its underside it had a white oxide film which was able to be removed from the original protective (black) coating by soaking for 20 hours in a $HF/HNO_3$ mixture. The metal surface was of bare metal. SEM pictures of the metal surface show hexagonally stepped depressions with clear step formation parallel to the 001 planes. The reverse side of the oxide film showed projections which mate with the depressions in the metal surfaces. They did however not exhibit a definite crystalline habit.

The plate was not etched before recoating, but only degreased. The new coating adhered excellently and had better electrochemical values than previously.

EXAMPLE 2

A titanium anode with an active anode surface of 420×495 mm and consisting of titanium wires of 4 mm diameter welded parallel to each other at 3 mm apart on to the current distribution structure was provided with a coating suitable for chlorine-alkali electrolysis according to the amalgam method, and was used in industrial electrolysis for 24 months. It was predried at 200° C. for 45 minutes, then put immediately into a furnace preheated to 860° C. and held for 10 minutes at 830° C. The anode was cooled in air to room temperature.

After this treatment, the coating could be peeled off in large pieces. The residual coating remaining in the edges of the structure was easily brushed off. The otherwise bare metal surface was covered in some places with a fine white oxide powder which was rinsed off in the normal degreasing process. Thereupon, the titanium structure was again coated and could afterwards be used in industrial electrolysis.

We claim:

1. A method of removing an electroconductive coating from a metal core electrode substrate comprising forming a non-adhesive intermediate layer of a compound of the metal substrate between the electroconductive coating and the substrate by thermally treating said electrode in a gas atmosphere containing at least a proportion of an oxygen carbon; nitrogen—or hydrogen yielding component or a mixture thereof and thereafter removing the electroconductive coating.

2. A method as claimed in claim 1, wherein an oxide, carbide, nitride or hydride is produced as the non-adhesive compound of the substrate metal.

3. A method as claimed in claim 1, wherein the thermal treatment is carried out at a temperature in the range of 400° to 900° C.

4. A method as claimed in claim 1, wherein a proportion of gas contained within the gas atmosphere is inert under the treatment conditions.

5. A method as claimed in claim 1, wherein air or a gas with a small proportion of oxygen is the oxygen-yielding component, and a hydrocarbon gas is the carbon-yielding component.

6. A method as claimed in claim 1, which further comprises disposing a predrying stage, particularly in the range of 130° to 250° C. before the thermal treatment.

7. A method as claimed in claim 1, wherein thermal treatment comprises a rapid passage through low temperature ranges.

8. A method as claimed in any of claims 1, 2, 3, 4, 5, 6 or 7 wherein the treatment at the higher temperature is effected at about 600° to 870° C. in a gas atmosphere, and in particular in air.

9. A method of removing an electrocatalytic conductive coating from a metal core electrode substrate comprising forming a non adhesive intermediate layer of a compound of the metal substrate between the electronegative coating and the substrate by anodic substrate in a non oxidizing fused salt bath at a temperature exceeding 650° C., and thereafter removing the electroconductive coating.

10. The method as claimed in claim 1 in which parts of the electrodes which support the active coating consists of expanded metal, wire or rods having a maximum diameter of under 1 cm.

11. The method as claimed in claim 10, wherein the thermal treatment is carried out over a time of less than 15 minutes between 750° and 870° C. in air.

12. The method as claimed in claim 1 or 9 in which parts of the electrodes which support the active coating consist of plates.

13. The method as claimed in claim 12, wherein the plates are treated for a time of more than 20 minutes, preferably in air, at a temperature of between about 600° and 700° C.

14. A method as defined in claim 1 or 9 in which the metal core substrate is a titanium valve metal or a titanium valve metal alloy.

* * * * *